US007273592B2

(12) United States Patent
Jacob et al.

(10) Patent No.: US 7,273,592 B2
(45) Date of Patent: Sep. 25, 2007

(54) COMBINATION EXHAUST GAS POST TREATMENT/MUFFLER DEVICE IN THE EXHAUST GAS SECTION OF AN INTERNAL COMBUSTION ENGINE

(75) Inventors: Eberhard Jacob, Krailling (DE); Hans-Peter Mai, Geggenau (DE)

(73) Assignees: MAN Nutzfahrzeuge Aktiengesselschaft (DE); Roth-Tecnik Austria Ges.m.b.H (DE)

( * ) Notice: Subject to any disclaimer, the term of this patent is extended or adjusted under 35 U.S.C. 154(b) by 699 days.

(21) Appl. No.: 10/822,543

(22) Filed: Apr. 12, 2004

(65) Prior Publication Data

US 2004/0202591 A1 Oct. 14, 2004

(30) Foreign Application Priority Data

Apr. 11, 2003 (DE) ..... 103 16 799

(51) Int. Cl.

| | |
|---|---|
| ***B01D 50/00*** | (2006.01) |
| ***F01N 3/00*** | (2006.01) |
| ***F01N 3/10*** | (2006.01) |
| ***F01N 5/00*** | (2006.01) |

(52) U.S. Cl. ..... 422/169; 60/274; 60/299; 181/212

(58) Field of Classification Search ..... 422/169–171, 422/173, 176, 177, 180, 181; 60/299, 302, 60/320; 181/232, 241

See application file for complete search history.

(56) References Cited

U.S. PATENT DOCUMENTS 5,063,736 A * 11/1991 Hough et al. ..... 60/286
5,285,640 A * 2/1994 Olivo ..... 60/274
5,426,269 A * 6/1995 Wagner et al. ..... 181/232
5,514,348 A 5/1996 Bayer et al.
6,722,124 B2 * 4/2004 Pawson et al. ..... 60/286
6,729,127 B2 * 5/2004 Woerner et al. ..... 60/297

FOREIGN PATENT DOCUMENTS

| | | |
|---|---|---|
| EP | 0 787 816 | 9/1999 |
| EP | 1 262 641 | 12/2002 |
| GB | 2 176 239 | 12/1988 |

* cited by examiner

*Primary Examiner*—Walter D. Griffin
*Assistant Examiner*—Lessanework T Seifu
(74) *Attorney, Agent, or Firm*—Robert W. Becker & Associates; Robert W. Becker

(57) ABSTRACT

A combination exhaust gas post treatment/muffler device in the exhaust gas section of an internal combustion engine is provided. The exhaust gas post treatment within the muffler, which forms sulfuric acid, takes place in at least one exhaust gas post treatment/muffler module, and only that housing thereof through which flows exhaust gas that is to be cleaned is produced from ferritic or austenitic stainless steel, thus making it possible to produce the outer walls of the muffler, as well as any inner element thereof, such as a transverse wall, that is disposed externally of the exhaust gas post treatment/muffler module of unalloyed sheet steel that is coated with aluminum or some other material.

12 Claims, 7 Drawing Sheets

COMBINATION EXHAUST GAS POST TREATMENT/MUFFLER DEVICE IN THE EXHAUST GAS SECTION OF AN INTERNAL COMBUSTION ENGINE

BACKGROUND OF THE INVENTION

The present invention relates to a combination exhaust gas post treatment/muffler device in the exhaust gas section of an internal combustion engine, especially a diesel engine of a commercial vehicle, such as a truck or bus, and including a muffler that is spatially delimited by a front and rear end wall as well as a peripheral outer wall, and in the interior of which is built in at least one preliminary oxidation catalytic converter, which significantly increases the $NO_2$ amount in the exhaust gas that is flowing through, and at least one exhaust gas post treatment device, whereby exhaust gas that is to undergo post treatment can be introduced into the muffler via an inlet tube, and after flowing through the preliminary oxidation catalytic converter as well as the exhaust gas post treatment device can again be conveyed out of the muffler in a cleaned and indirectly muffled state.

Combination exhaust gas post treatment/muffler devices of the aforementioned type have been disclosed, for example, in the 23$^{rd}$ International Viennese Motor Symposium on the 25$^{th}$ and 26$^{th}$ of Apr. 2002 and have been documented in the Progress Reports, VDI series 12 Nr. 490, volume 2, Düsseldorf, VDI publication 2002, pages 196-216. In this connection, a system was introduced where four exhaust gas post treatment modules were disposed in a muffler for parallel flow therethrough, whereby each module, enclosed in a casing, is provided with a circular cylindrical preliminary oxidation catalytic converter and, following immediately coaxially a circular cylindrical particle separator having the same diameter.

Due to the use of sulfur-containing fuels, there results during the oxidation of the exhaust gas sulfuric acid that has a very corrosive effect within the exhaust gas post treatment/muffling system. This formation of corrosion caused by sulfuric acid is counteracted by the use of high-quality austenitic stainless steel materials during the manufacture of the exhaust gas post treatment and muffling devices. However, in comparison to structural steels these austenitic stainless steels are much more expensive, and require for the processing of appropriate semi-finished articles, such as sheets or plates, also considerably more complicated and expensive tools, which on the whole thus cause relatively high manufacturing costs for such systems that are resistant to sulfuric acid. In comparison to exhaust gas post treatment/muffling systems that require no configuration that is resistant to sulfuric acid, the system costs for an embodiment that is resistant to sulfuric acid increases by a factor of 3 to 5.

It is therefore an object of the present invention to provide exhaust gas post treatment/muffling devices of the aforementioned general type with structural features that provide the possibility of remedying the problem of corrosion caused by sulfuric acid in a cost-reducing manner.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 2:
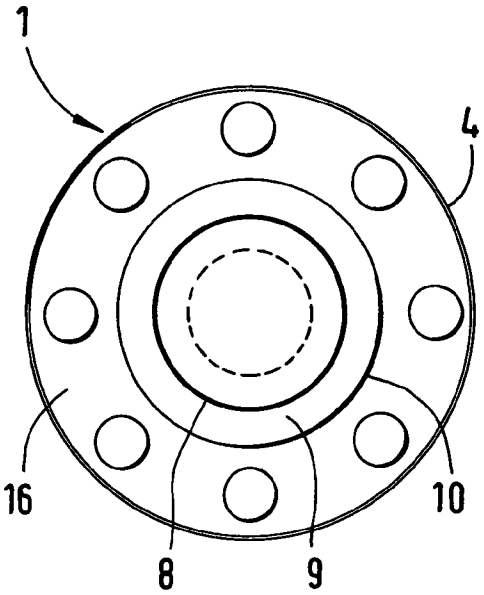
FIGS. 1 and 2 are a longitudinal section and a cross-section respectively through a first embodiment of the invention with an exhaust gas post treatment/muffling module embodied pursuant to a first basic principle.

The combination exhaust gas post treatment/muffler device of the present application is characterized primarily in that built into the muffler, as a system core, is at least one exhaust gas post treatment/muffler module, subsequently referred to as EP/M module, which is provided with a housing composed of several parts, whereby at least one preliminary oxidation catalytic converter is disposed in a first housing portion, wherein a second portion of the housing follows the first portion, is widened in a funnel-shaped manner, and delimits a transfer chamber, wherein a third portion of the housing follows a second portion and in which is disposed an exhaust gas post treatment device, for example a particle filter, catalytic particle separator, or a catalytic converter or catalyzer, wherein following the third housing portion is an end housing portion that collects cleaned exhaust gas and conveys such gas out of the muffler-in a muffled manner, and wherein all of the housing portions of the EP/M module are made of ferritic or austenitic stainless steel that is resistant to sulfuric acid, while all of the outer walls, the inlet tube, and every internal element of the muffler, such as transverse or support wall, that is disposed externally of the EP/M module, are made of an unalloyed sheet steel that is coated with aluminum or some other material for protection against corrosion.

An important basic concept of the invention is that the exhaust gas post treatment within the muffler that forms sulfuric acid takes place in at least one exhaust gas post treatment/muffler module, and only that housing through which exhaust gas that is to be cleaned flows is produced of ferritic or austenitic stainless steel, and it is thereby possible to produce the outer walls of the muffler, as well as any internal device therein, such as the transverse wall, that is disposed externally of the exhaust gas post treatment/muffler module, of an alloyed sheet steel that is coated with aluminum or some other material. Sheet steel requires low material costs and low tooling costs for the muffler, and when viewed on the whole also lower manufacturing costs for the overall system exhaust gas post treatment/muffling.

Within the framework of the inventive basic principle, it is possible in an advantageous way to appropriately design the exhaust gas post treatment/muffler module for the requirements of its use, whereby in the present application three basic principles are provided that are all of the inventive nature.

Further specific features of the present invention will be described in detail subsequently.

DESCRIPTION OF SPECIFIC EMBODIMENTS

Referring now to the drawings in detail, the inventive combination exhaust gas post treatment/muffler device is disposed in the exhaust gas section of an internal combustion engine which can, for example, be a diesel engine of a commercial vehicle such as a truck or bus. This exhaust gas post treatment/muffler device is constructed in a modular fashion.

With all of the embodiments of the invention, the first module is basically the muffler 1, which is spatially delimited in general by a front end wall 2, a rear end wall 3, and a peripheral outer wall 4. The latter can be cylindrical and can have a circular, oval, rectangular or square cross-section, or can also bulge in the manner of a barrel.

Provided in the interior of the muffler 1 is at least one preliminary oxidation catalyzer or catalytic converter 5, subsequently called P-cat, which increases the $NO_2$ fraction in the exhaust gas that is flowing through, and downstream thereof in a direction of flow at least one exhaust gas post treatment device 6, which can be a catalytic or non-catalytic particle separator or catalyzer.

The or all of the P-cats 5, and the or all of the exhaust gas post treatment devices 6, are integral constituents of at least one exhaust gas post treatment/muffler module 7, which pursuant to the invention is built into the muffler 1 as the core of the system; the module 7 is subsequently abbreviated as EP/M module 7.

Figure 3:
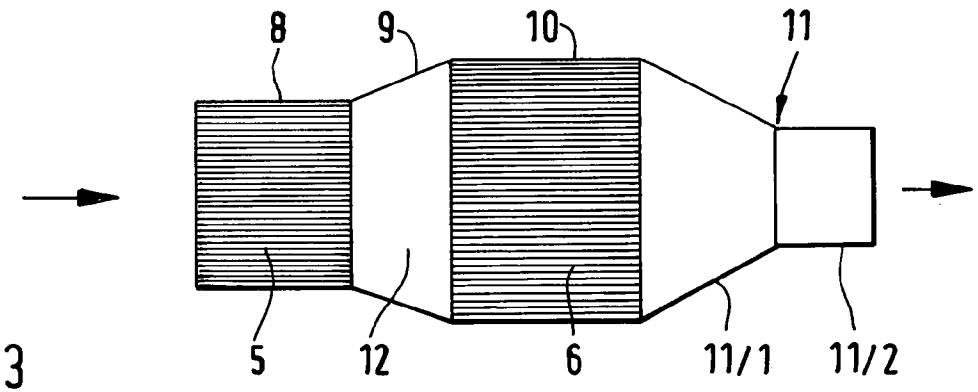
FIG. 3 a detailed longitudinal section of the exhaust gas post treatment/muffling module of FIGS. 1 and 2.
Figure 18:
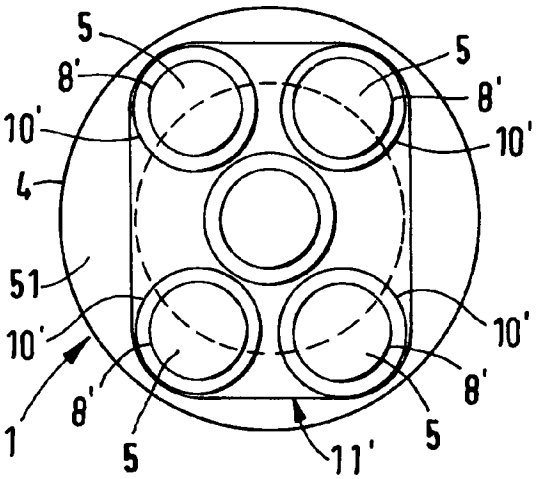
FIGS. 17 and 18 a longitudinal section and a cross-section respectively through a further embodiment of the invention having an exhaust gas post treatment/muffling module embodied pursuant to a second basic principle.
Figure 19:
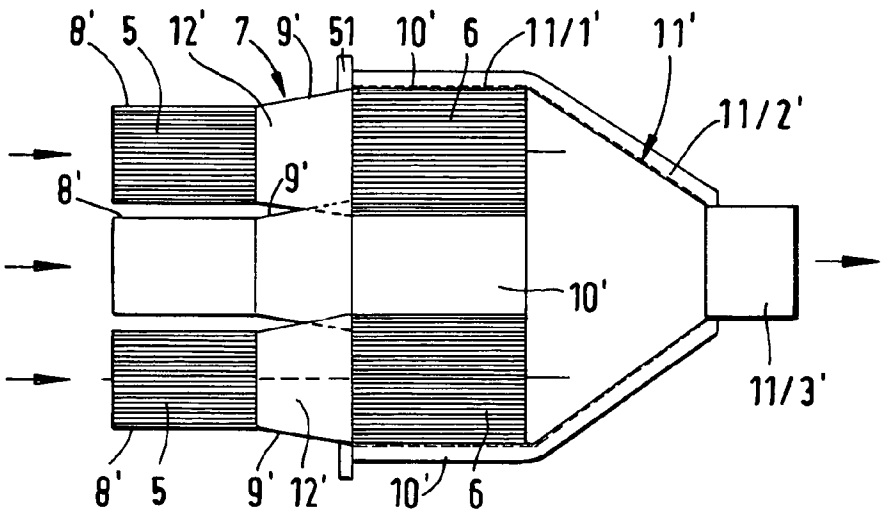
FIG. 19 a longitudinal section illustrating the module of FIGS. 17 and 18 in detail.
Figure 21:
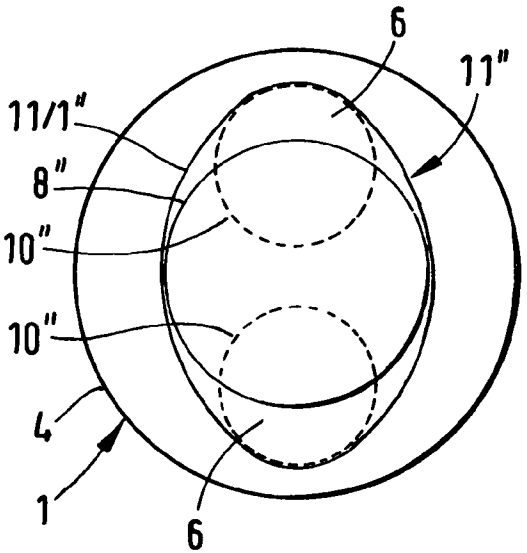
FIGS. 20 and 21 a longitudinal section and a cross-section respectively through a further embodiment of the invention having an exhaust gas post treatment/muffling module embodied pursuant to a third basic principle.
Figure 20:
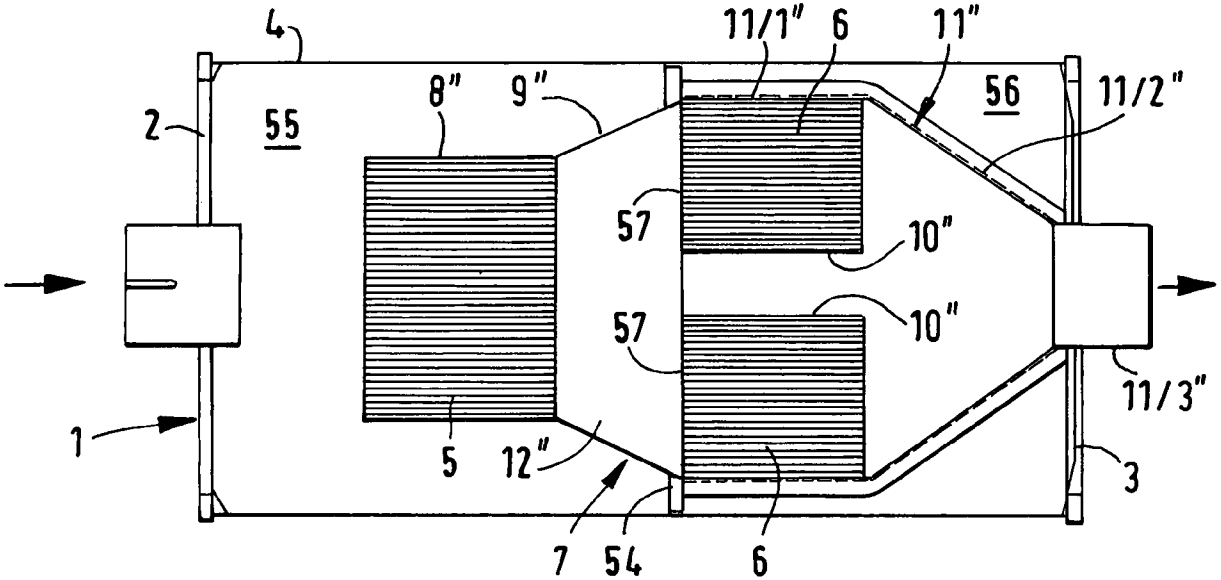
Figure 22:
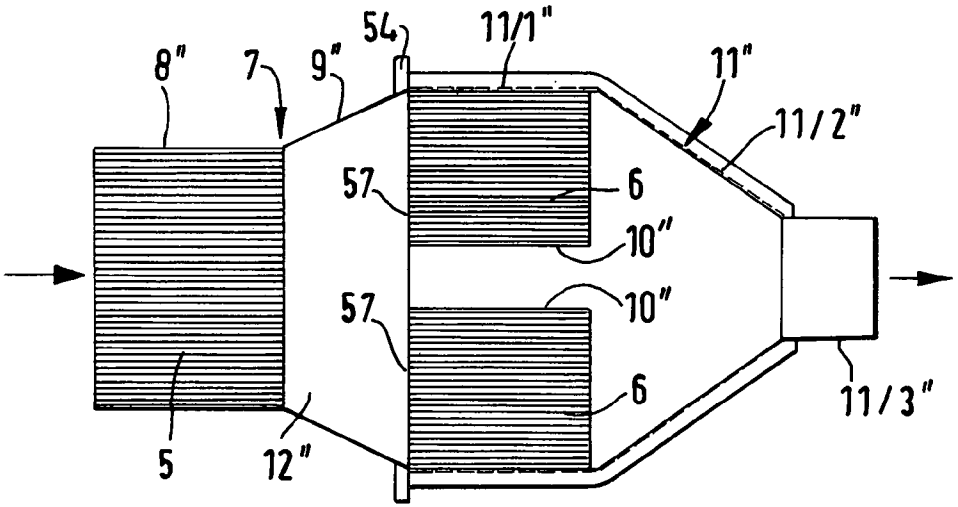
FIG. 22 a longitudinal section illustrating the modules of FIGS. 20 and 21 in detail.

Pursuant to the invention, the EP/M module 7 is provided with a housing that is composed of a plurality of parts and that is differently configured, partitioned and assembled in conformity with the three illustrated construction principles (see FIGS. 3, 19 and 22). Independently of the different details, the housing has four successive portions 8,9,10 and 11 (FIGS. 1 to 16), 8', 9', 10' and 11' (FIGS. 17 to 19) or 8", 9", 10" and 11" (FIGS. 20 to 22). In this connection, at least one P-cat 5 is built into the first housing portion 8, 8', 8". The second housing portion 9, 9', 9", which follows the first portion 8, 8', 8", widens in a funnel-shaped manner to a greater cross-section and forms a transfer chamber 12, 12', 12". The third housing portion 10, 10', 10", which follows the second portion 9, 9', 9", accommodates at least one exhaust gas post treatment device 6. Following the third housing portion 10, 10', 10" is a housing end portion 11, 11', 11", which conducts out of the muffler 1 the exhaust gas that has been collected and has been cleaned after flowing through the P-cat or cats 5 and the exhaust gas post treatment device or devices 6. The various embodiments and different types of construction will be discussed in greater detail subsequently.

Pursuant to the invention, all of the parts or portions 8, 9, 10, 11, 8', 9', 10', 11' or 8", 9", 10", 11" of the housing of the EP/M module 7 are made of ferritic or austenitic stainless steel that is resistant to sulfuric acid, whereas all of the outer walls 2, 3, 4, an inlet tube 13, and every internal element, such as a transverse or support wall of the muffler 1, which are disposed externally of the EP/M module 7, are made of unalloyed sheet steel that, for protection against corrosion, is coated with aluminum or also with some other corrosion protecting material; such steel can, for example, be a steel having the standard designation ST 12-03. The connection between the end walls 2,3 and the peripheral wall 4 of the muffler 1 is effected by known methods, such as folding. The muffler 1, which is produced in this way from relatively inexpensive steel, thus serves as a canning or jacket for the higher quality (from a material standpoint) and more cost intensive system core, which is formed by the EP/M module or modules 7 and protects the latter during operational use from mechanical effects. In addition, the muffler 1, which is preferably also provided with components that serve as a high-pass filter for the low-frequency muffling range, serves as a pre-heating chamber for the EP/M module or modules 7, and provides for an optimum temperature about the latter.

Further details concerning the three different construction principles of the EP/m modules 7 follow.

The EP/M module 7 illustrated in detail in FIG. 3 comprises, with the first construction principle, a housing that is composed of two parts. The division of the housing is expedient at two locations, whereby the interface can lie either between the first housing portion 8 and the second housing portion 9, or between the third housing portion 10 and the fourth or end housing portion 11. Thus, either the two first housing portions 8 and 9, or the two remaining housing portions 10 and 11, respectively form a housing part that is to be prefabricated. Alternatively, the first three housing portions 8, 9, 10, and the end housing portion 11, respectively form a housing part that is to be prefabricated, whereby the last mentioned is the preferred version. Here, the first housing portion 8 has a circular cylindrical configuration and is adapted on the outside to the P-cat 5 built into it. The second housing portion 9, which delimits the transfer chamber 12, coaxially follows the first housing portion 8. Coaxially adjoining the housing portion 9 is the circular cylindrical third housing portion 10, which has a considerably greater diameter than does the first housing portion 8; the third housing portion 10 is adapted on the outside to the exhaust gas post treatment device 6 that is built into it.

The fourth or end housing portion 11 coaxially follows the housing portion 10 via an initial portion 11/1 that tapers in a funnel shaped manner starting with the same diameter as the diameter of the third housing portion 10. The initial section 11/1 merges into a circular cylindrical end tube 11/2 with which it is guided in a gas tight manner out of the muffler 1. The two housing parts, together with the built-in P-cat 5 and exhaust gas post treatment device 6, respectively form a partial module, within the EP/M module 7, that are each to be produced independently of the other. The two partial modules are joined during final assembly at the interface that is provided, whereby the connection at the abutting housing portions is either fixedly gas tight, e.g. by welding, or the two housing portions can be detachably interconnected via a gas tight connection mechanism. The detachable connection is expensive, but in the event of a defect enables a rapid replacement of the exhaust gas post treatment device 6.

For muffling purposes, the end housing portion 11 can be entirely or partially perforated, or provided with individual holes 14 (see FIGS. 8, 9, 10, 11, 14, 15) and/or the housing portion 11 can be coated on the outside, either along its entire length or only over a partial length, with sound dampening or absorption material 15 (see FIGS. 7, 8, 9, 10, 11, 12, 14, 15).

After being joined together, and the application of any sound-dampening or absorption material 15, the two partial modules form a prefabricated EP/M module 7, which is then built into the muffler 1 as the system core. In the installed state of the EP/M module 7, due to its inventive configuration in the region of its end housing portion 11 with the very large free cross-section of the funnel absorption section, it is possible to dampen or muffle with this module 7 the outlet noise, especially in the high and middle frequency range without a noticeable loss in pressure. This occurs here not by reflection of the sound waves as is customary, but rather by conversion of the sound energy into heat.

Greater details of the embodiments having the described EP/M module 7 follow.

Figure 1:
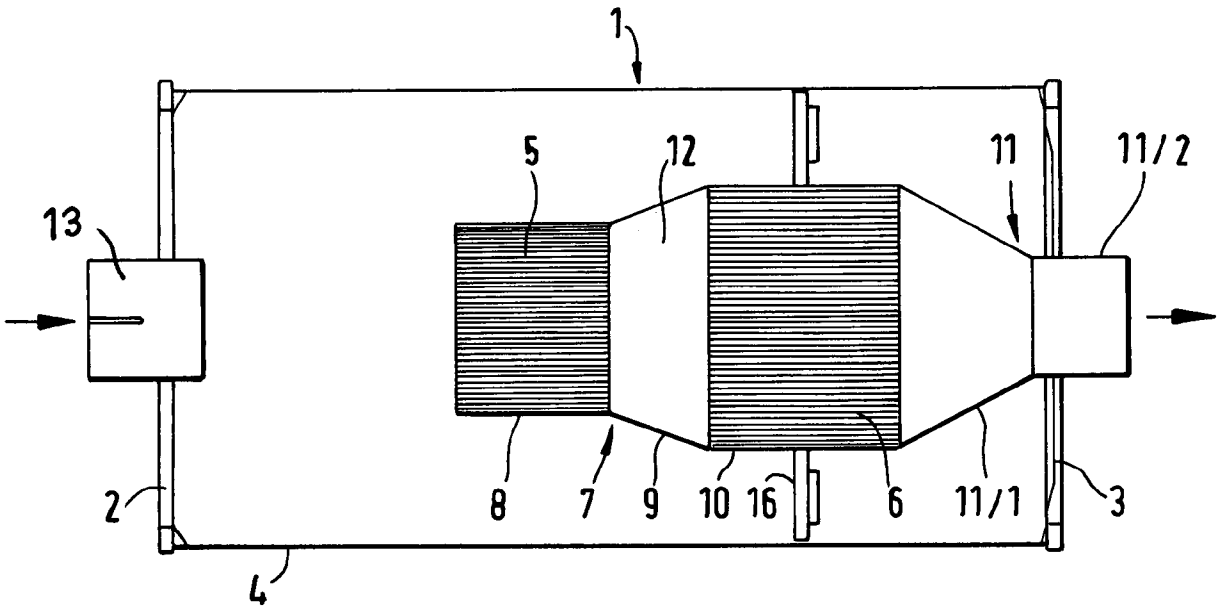

FIG. 1 shows the inlet tube 13 disposed centrally in the front end wall 2 of the muffler 1, and coaxially aligned therewith the EP/M module 7 is built into the muffler and has the end tube 11/2 guided centrally through the rear end wall 3 and out of the muffler 1 in a gas tight manner. In the interior of the muffler 1, the EP/M module 7 is held approximately in the middle of its length in an installed position by a non-gas tight transverse wall 16 that is perforated or provided with apertures, so that the entire installed length of the EP/M module 7 in the muffler 1 can have exhaust gas flow around it from the outside for a preliminary heating thereof. In the muffler 1, the transverse wall 16 furthermore forms a muffling device. After installation of the EP/M module 7 in the interior of the muffler 1, the rear end wall 3 of the muffler is connected with the peripheral outer wall 4 thereof, for example by folding the edge over.

Figure 4:
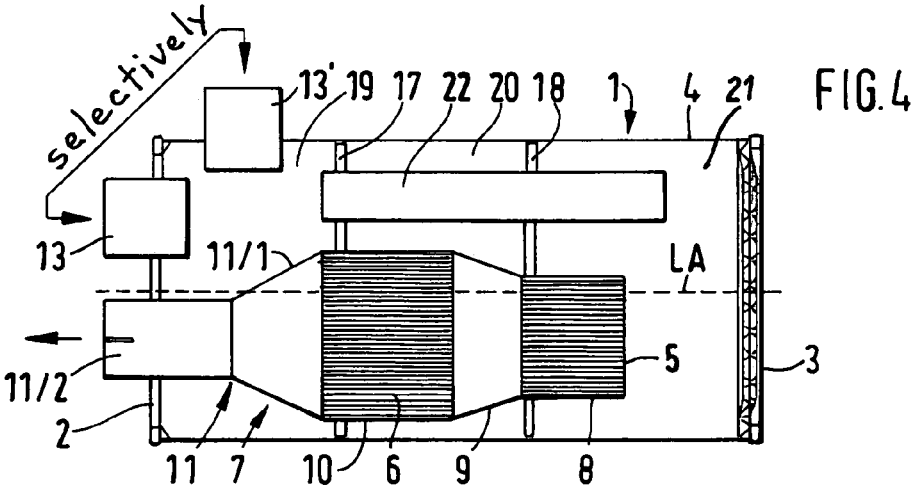
FIGS. 4 to 14 longitudinal sections of a further embodiment of the invention having an exhaust gas post treatment/muffling module of the type illustrated in FIG. 3.

FIG. 4 shows the inlet tube 13 selectively either extending eccentrically through the front end wall 2 or radially through the peripheral outer wall 4 (see 13'). The EP/M module 7 is eccentrically installed in the interior of the muffler 1 parallel to the longitudinal axis LA thereof, such that the end tube 11/2 is guided to the outside in a gas tight manner through the end wall 2, and the entry cross-section is disposed at a great distance from the rear end wall 3. Internally of the muffler 1, the EP/M module 7 is held in the installed position by two transverse walls 17, 18 that are axially spaced from one another, whereby these two transverse walls 17, 18 divide the inner space of the muffler 1 into three chambers, namely a front exhaust gas flow-in chamber 19, a middle heat chamber 20, and a rear transfer chamber 21. A tube 22 that passes through the two transverse walls 17, 18 conveys the exhaust gas supplied via the inlet tube 13 into the exhaust gas flow-in chamber 19 from such chamber to the transfer chamber 21, from where it then flows through the EP/M module 7 in the opposite direction for a cleaning of the gas. The transverse wall 17 is preferably gas tight, whereas the transverse wall 18 is preferably permeable to gas, for example being perforated or being provided with apertures. The transverse walls 17, 18 and the tube 22 furthermore form muffling devices in the muffler 1.

Figure 5:
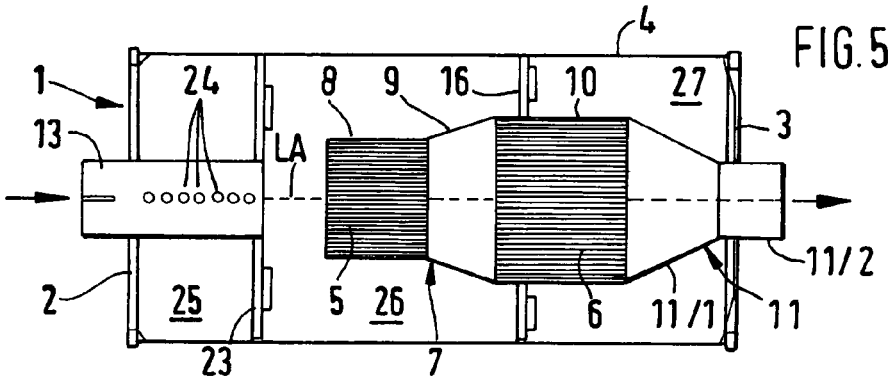

FIG. 5 shows the EP/M module 7 installed in the muffler 1 in the same way as in FIGS. 1 and 2. However, here the inlet tube 13 is extended relatively far centrally into the interior of the muffler 1, where at the end it is guided through a second transverse wall 23 that is parallel to the transverse wall 16; in the region between this transverse wall 23 and the front end wall 2 of the muffler 1, the inlet rube 13 is perforated or is provided with holes 24. Both of the transverse walls 16, 23 are permeable to gas, for example via a plurality of apertures or openings, and form together with the perforated inlet tube 13 on the one hand muffling elements, and on the other hand space dividers in the muffler 1, as a result of which the interior of the muffler is divided into a front chamber 25, a middle chamber 26, and a rear chamber 27. A small portion of the exhaust gas is introduced via the holes 24 into the front chamber 25, while the largest portion of the exhaust gas is introduced into the middle chamber 26 and from there flows through the EP/M module 7.

Figure 6:
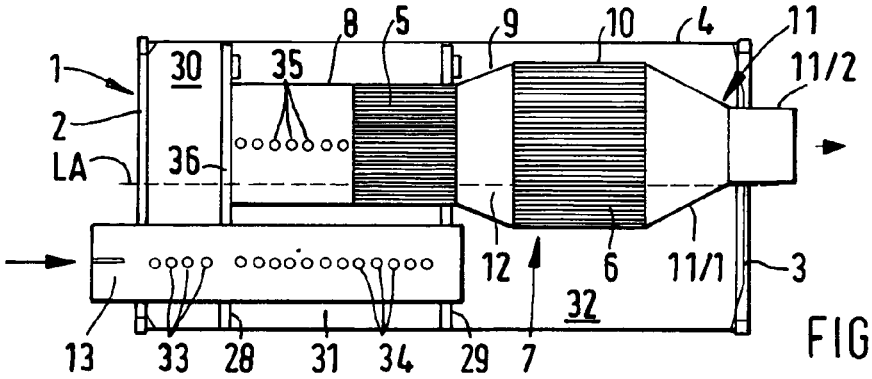

FIG. 6 shows the inlet tube 13, eccentrically and parallel to the longitudinal axis LA of the muffler 1, extending relatively far into the muffler to about the middle of its longitudinal extension, and from there is guided through two transverse walls 28, 29 that are spaced far apart and are permeable to gas via perforations or apertures. These transverse walls 28, 29 serve as an internal muffler support on the one hand for the inlet tube 13, and on the other hand for the adjacent EP/M module 7 that is also built into the muffler 1 eccentrically and parallel to the longitudinal axis thereof. The two transverse walls 28, 29 divide the interior of the muffler into a front chamber 30, middle chamber 31 and rear chamber 32. In the region of the front and middle chambers 30, 31 the inlet tube 13 is perforated or provided with holes 33, 34, so that the exhaust gas can be supplied via the inlet tube 13 essentially in particular into the rear chamber 32, but partially also via the holes 33, 34 into the front and middle chambers 30, 31. In addition, in this embodiment the initial portion 8 of the housing is extended on the inlet side ahead of the installation region of the P-cat 5 toward the front as far as the front transverse wall 28, and in this region is perforated or is provided with holes 35. The exhaust gas supplied into the muffler 1 flows from the rear chamber 32, via the middle chamber 31, to the front chamber 30, from where it enters, through an aperture 36 in the front transverse wall 28, and from the middle chamber 31 via the holes 35, into the EP/M module 7, and after flowing therethrough leaves again in a cleaned state via the end tube 11/2 that is guided in a gas tight manner out of the rear end wall 3 of the muffler 1. The transverse walls 28, 29, and the internal portion of the inlet tube 13, additionally serve for sound dampening or muffling.

Figure 7:
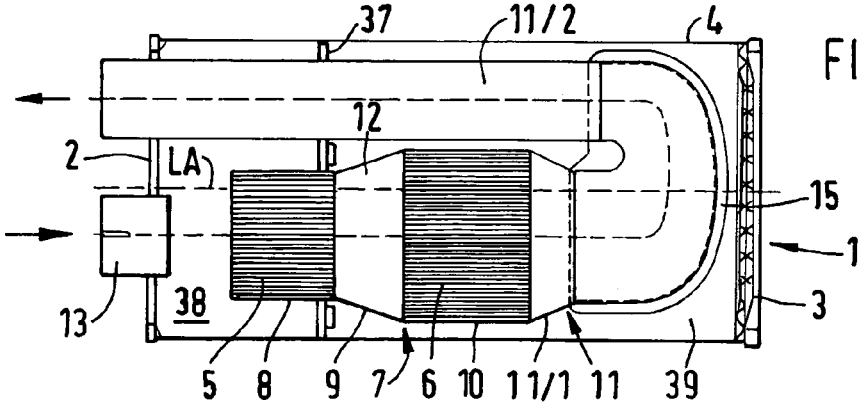

FIG. 7 shows an embodiment of the EP/M module 7 where the end housing portion 11 has a U-shaped path by means of which the cleaned exhaust gas can again be conveyed out of the inlet end of the muffler 1 via the end tube 11/2. The inlet tube 13 passes eccentrically through the front end wall 2 and extends only slightly into the interior of the muffler 1. Extending coaxially to the inlet tube 13 are the housing portions 8, 9, 10 and 11/1 of the EP/M module 7. Provided for the support of this EP/M module 7 in the muffler 1 is a transverse wall 37 that is made gas permeable via perforations or apertures. The first housing portion 8 is supported in a lower opening of the transverse wall 37, and the end tube 11/2 of the housing portion 11 is supported in an upper opening. The transverse wall 37 divides the interior of the muffler into a front chamber 38 in a rear chamber 39, and also serves together with the relatively long end tube 11/2 for muffling.

Figure 8:
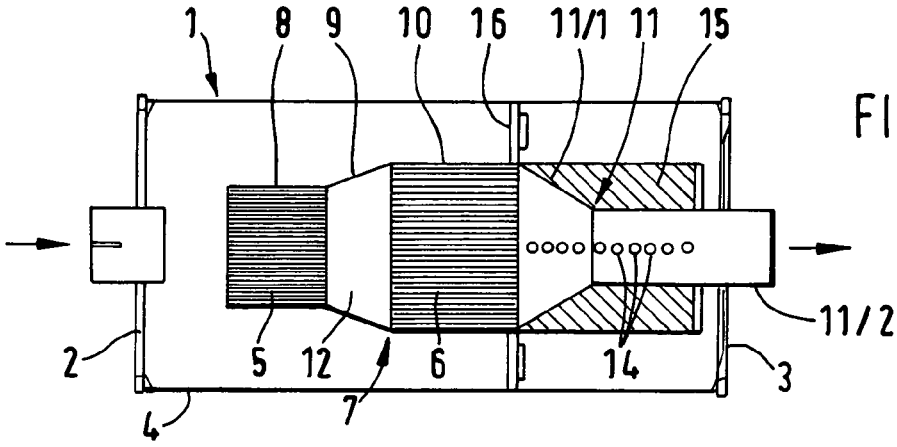

In comparison to the embodiment of FIG. 1, FIG. 8 shows the EP/M module 7 disposed axially closer to the inlet tube 13 and being provided with a longer end tube 11/2. In addition, the end housing portion 11 is provided with a perforation or holes 14, and is coated over nearly its entire length with an outer layer 15 of noise-dampening or absorption material.

Figure 9:
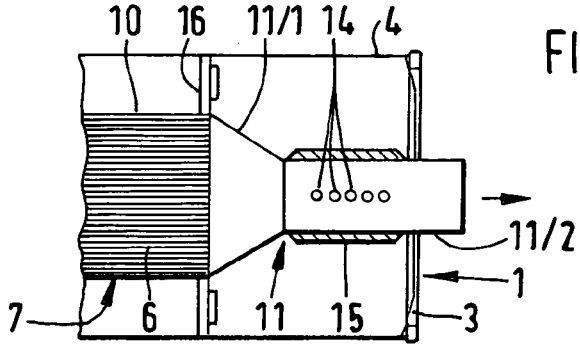

The embodiment of FIG. 9 differs from that of FIG. 8 in that only the end tube 11/2 is provided with a perforation or holes 14, and on the outside is coated with a layer 15 of dampening or absorption material.

Figure 10:
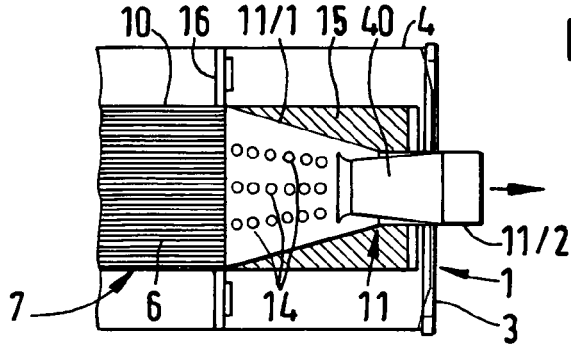

The embodiment of FIG. 10 differs from that of FIG. 8 in that built into the end tube 11/2 of the end housing portion 11 is a venturi nozzle 40 that contributes to a further reduction of the noise level at the outlet.

Figure 11:
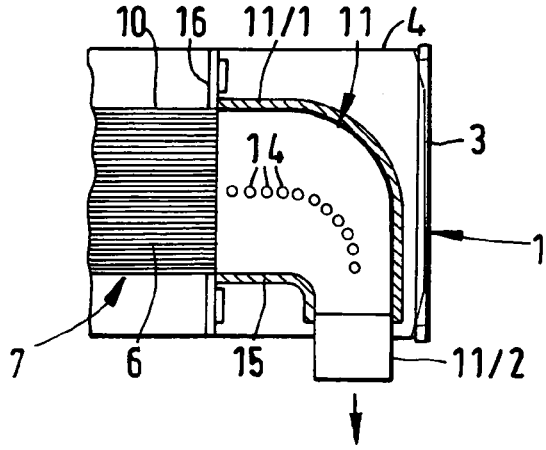
Figure 12:
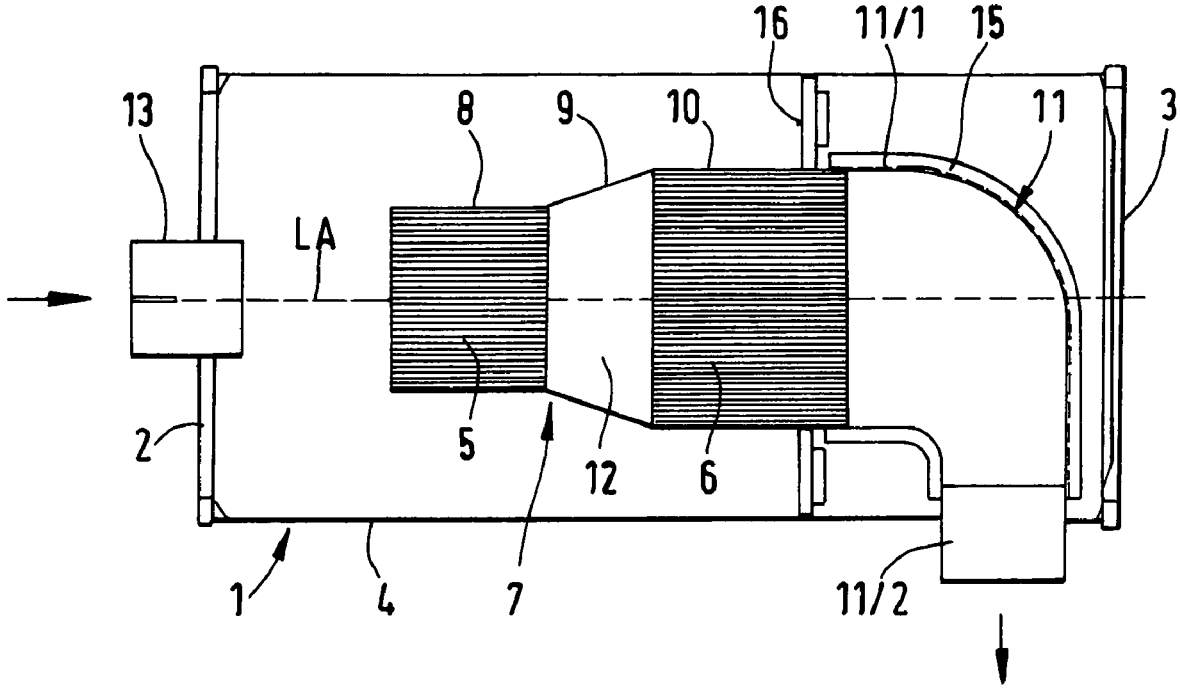

The embodiments of FIGS. 11 and 12 differ from the embodiments of FIGS. 1 to 10 in that the end housing portion 11 is not linear, but rather is curved in a funnel-shaped manner from the housing portion 10, and in particular initially cylindrically and then tapers with a quarter arc to the cylindrical end tube 11/2, which is here laterally guided out of the muffler 1 via the peripheral outer wall 4 thereof. In the region 11/1, the end housing portion 11 is perforated or provided with holes 14, and on the outside is coated with a sound dampening or absorption material 15. In contrast to the embodiment of FIG. 11, with the embodiment of FIG. 12 the section 11.1 of the end housing portion 11 is composed of individually produced double half shells, which after being joined together, and the insertion of the end tube 11/2, is attached to the housing portion 10 as a unitary end housing portion 11; here the housing portion 10 projects to the rear somewhat beyond the transverse wall 16, and on its projecting partial region accommodates the end housing portion 11.

Figure 13:
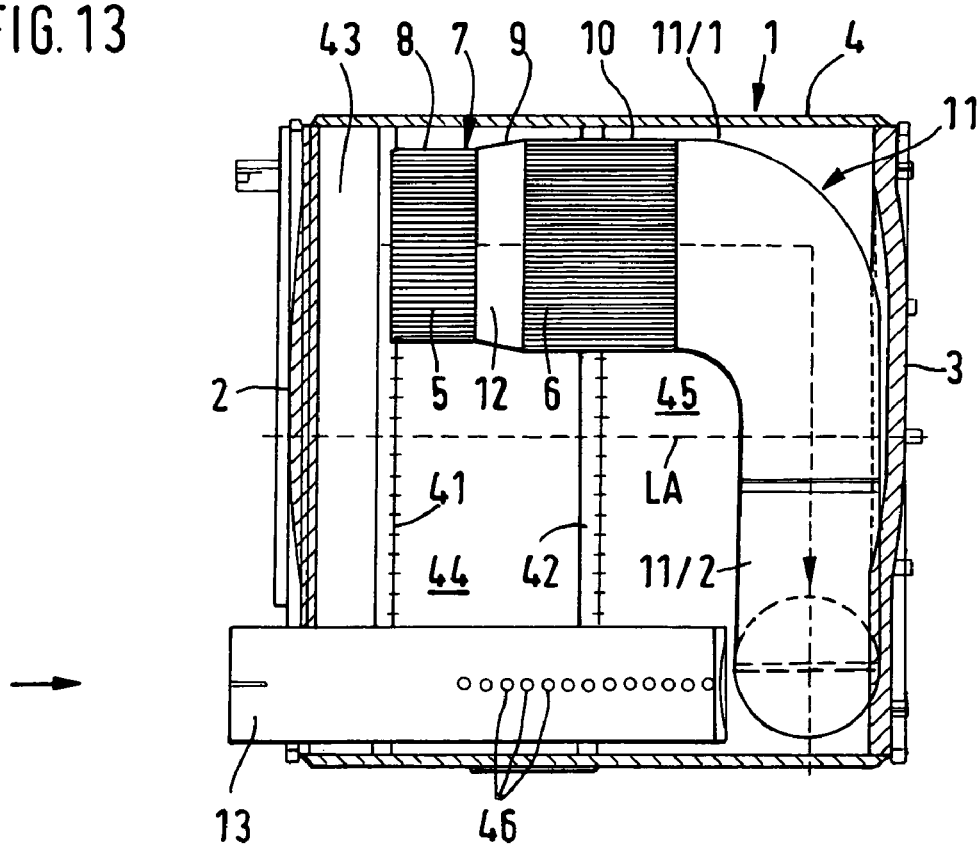

FIG. 13 shows an embodiment that is similar to that of FIG. 6. Here, the muffler 1 does not have a circular but rather a somewhat rectangular or square cross-section. In the lower region, the inlet tube 13 is guided eccentrically and parallel to the longitudinal axis LA of the muffler 1 into the interior thereof, and from there passes through two transverse walls 41, 42 that support it and are permeable to gas via perforations or holes. The EP/M module 7 of this embodiment is comparable to that of FIG. 12, the end tube 11/2 of the end housing portion 11 here not being linear but rather angled off and being guided laterally out of the muffler 1 through the peripheral outer wall 4 approximately at the level of the inlet tube 13. The EP/M module 7 is built into the muffler 1 such that its housing portions 8, 9, 10, with the built-in P-cap 5 and exhaust gas post treatment device 6 extending in the upper region and parallel to the longitudinal axis LA of the muffler 1. This EP/M module 7, as well as the inlet tube 13, are held by the transverse walls 41, 42, which along with the inlet tube 13 and the end housing portion 11 also serve for sound dampening. The transverse walls 41, 42 divide the interior of the muffler into a front chamber 43, a middle chamber 44 and a rear chamber 45. In the region of the middle chamber 44 and the rear chamber 45, the inlet tube 13 is here perforated or provided with holes 46, so that exhaust gas from the inlet tube 13 can enter not only into the rear chamber 45 but also to a lesser degree laterally into the middle and rear chambers 44, 45. From there, the exhaust gas passes via the permeable transverse walls 41, 42 back into the front chamber 43, from where it can enter the EP/M module 7 so as to be able to pass therethrough.

Figure 14:
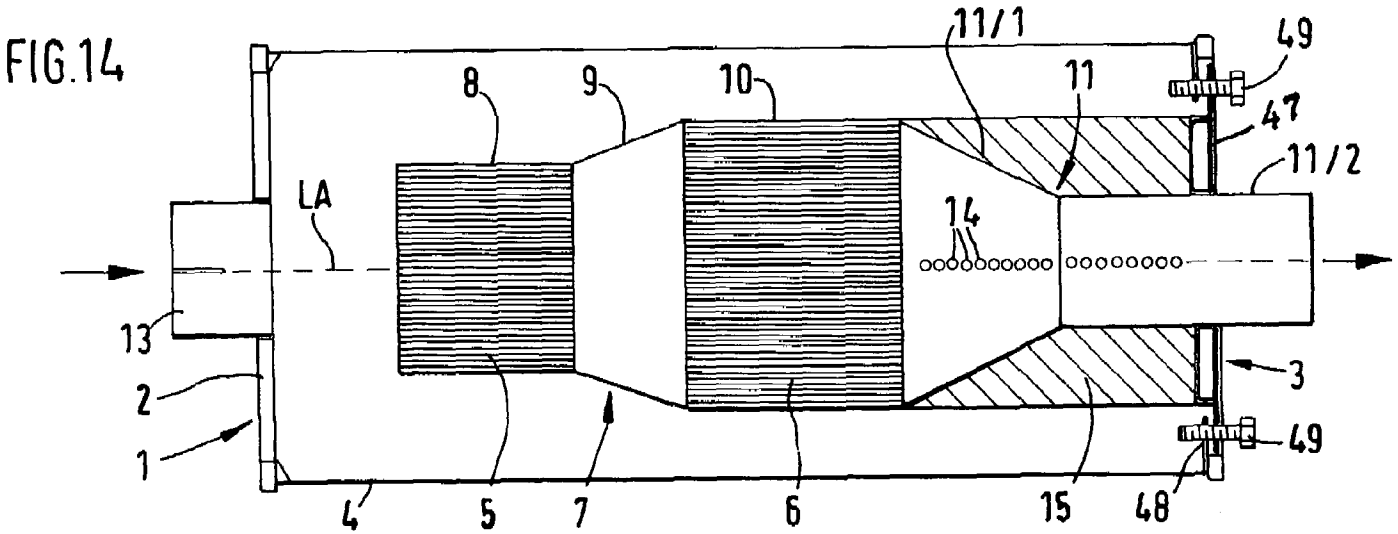

The embodiment of FIG. 14 is similar to that of FIG. 8. The important difference is that here the EP/M module 7 can be disposed in the muffler 1 so as to be easily replaceable; for this purpose, it is secured to an end plate 47 that forms the central portion of the here two-part rear end wall 3 of the muffler 1. The outer, annular portion 48 of the end wall 3 is united with the peripheral outer wall 4 by folding, and the end plate 47, with the EP/M module 7, is secured to the annular portion 48 via a plurality of clamping or screw connectors 49. To the extent necessary, this EP/M module 7 could additionally be internally supported in the muffler 1 by a transverse wall 16, as with the embodiment of FIG. 8.

Figure 16:
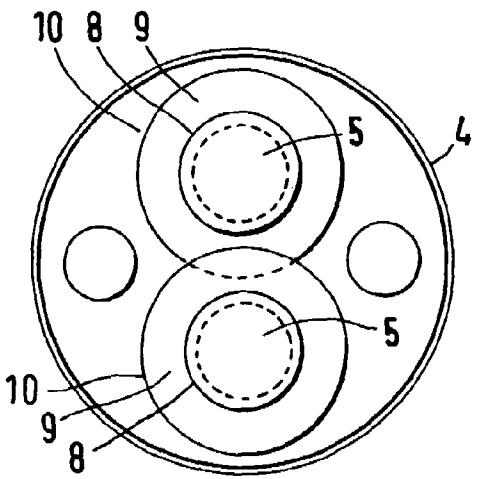
FIGS. 15 and 16 a longitudinal section and a cross-section respectively of a further embodiment of the invention having two exhaust gas post treatment/muffling modules of the type shown in FIG. 3.
Figure 15:
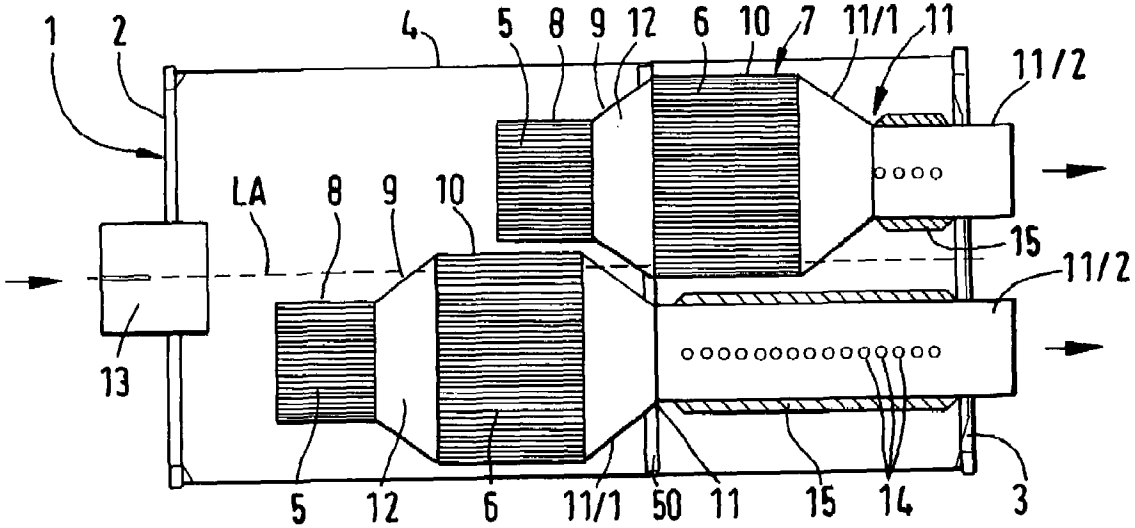

The embodiment of FIGS. 15 and 16 is provided with two EP/M modules 7 of the type of construction also used in FIG. 9. However, these modules have different length end tubes 11/2 at their end housing portions 11 so that, as illustrated in FIG. 15, they are axially offset relative to one another yet can respectively be installed parallel to the longitudinal axis LA of the muffler 1 and in an axial projection partially overlapping in the muffler. A non-gas tight transverse wall 50 holds the two EP/M modules 7 in the installed position, with the other support position for these modules being provided by the rear end wall 3 of the muffler 1, through which the end tubes 11/2 of the modules are guided in a gas tight manner.

Figure 17:
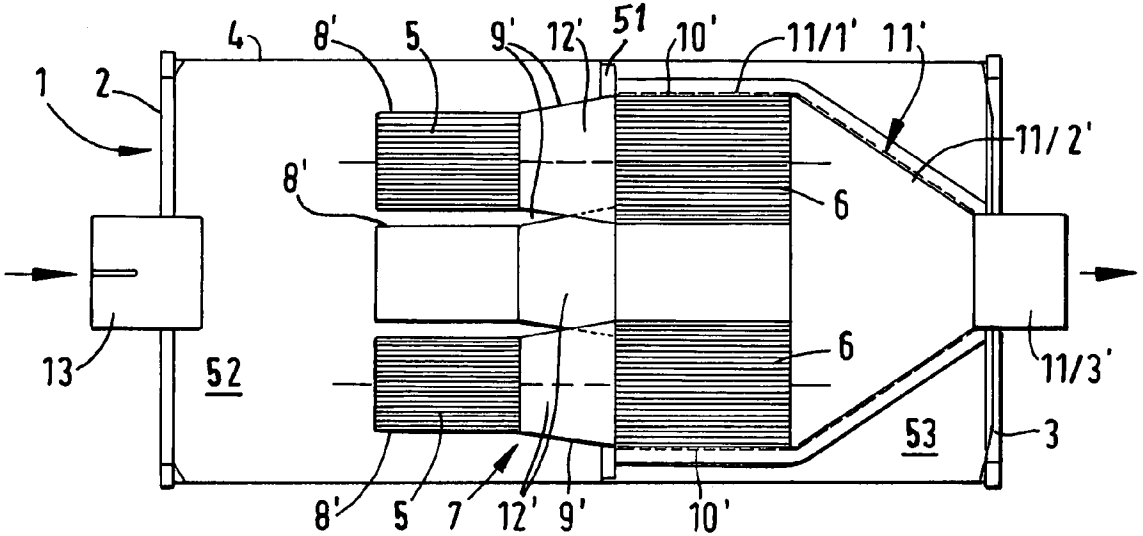

FIGS. 17 to 19 show an embodiment of the invention having an EP/M module 7 configured pursuant to a second basic principle. This EP/M module 7, which forms the system core in the muffler 1, is composed of a plurality, in the illustrated embodiment four, exhaust gas post treatment modules, which open out into an end housing portion 11'. In this connection, all of the exhaust gas post treatment modules preferably have the same design and configuration, and are provided in there respectively own housing in the beginning with a P-cat 5, and on the outlet side with a respective exhaust gas post treatment device 6, and between them with a transfer chamber 12' that widens in a tunnel-shaped manner toward the post treatment device. The housing of this EP/M module 7 is thus composed of the housings of the exhaust gas post treatment modules and of the common end housing portion 11'. The first housing portion is here formed by the first housing portion 8' of the exhaust gas post treatment modules. A second housing portion is here formed by the second housing portion 9' of the exhaust gas post treatment modules. The third housing portion is here formed by the third housing portion 10' of the exhaust gas post treatment modules. Each first housing portion 8' is respectively embodied in a circular cylindrical manner and is adapted on the outside to the P-cat 5 that is built therein. Following each of these first housing portions 8' in a coaxial manner, and in a funnel-shaped widening manner, is a second housing portion 9' that delimits a transfer chamber 12'; following this is again coaxially a circular cylindrical third housing portion 10'. In this connection, each first housing portion 8' is adapted on the outside to the P-cat 5 that is built therein. In addition, each third housing portion 10' is adapted on the outside to the exhaust gas post treatment device 6 that is built therein. These prefabricated exhaust gas post treatment modules are disposed in the interior of the muffler 1 with their housings being disposed axis parallel to one another and to the longitudinal axis of the muffler 1, with each module passing through an opening in a transverse wall 51, to which it is gas tight on the outside. This transverse wall 51 in the muffler 1 separates an exhaust gas flow-in chamber 52 from a further chamber 53. The exhaust gas passes via the inlet tube 13 into the exhaust gas flow-in chamber 52. At the inlet side, each of the exhaust gas post treatment modules communicates with the exhaust gas flow-in chamber 52, and on the outlet side opens into the end housing portion 11'. With this type of EP/M module 7, the essentially rectangular starting region 11/1' of the end housing portion 11' peripherally surrounds the third housing portion 10' of the exhaust gas treatment modules on the outside, and is adapted with its rounded corner regions, as visible from FIG. 18, in a form-fitting manner to the peripheral portions of the modules. In addition, this end housing portion 11' is secured at its end to the transverse wall 51 in a gas tight and fixed manner or via a gas tight yet detachable connecting mechanism. Downstream of the exit regions of the exhaust gas post treatment modules, the end housing portion 11' tapers via a central portion 11/2' that follows the starting region 11/1' to a circular cylindrical end tube 11/3' by means of which the end housing portion 11' is guided in a gas tight manner out of the muffler 1.

FIGS. 20 to 22 show a further embodiment of the invention with an EP/M module 7 embodied pursuant to a third basic principle. This EP/M module 7, which forms the system core in the muffler 1, is provided with a housing composed of a plurality of individual prefabricated partial housings 8", 9", 10", 11". A P-cat 5 is installed in the preferably circular cylindrical first housing portion 8". Coaxially following this first housing portion 8", downstream from the P-cat 5, is a second housing portion 9", which widens in a funnel-like manner, delimits a transfer chamber 12", and which is connected at its end in a gas tight manner to a transverse wall 54. In the muffler 1, this transverse wall 54 separates a front exhaust gas flow-in chamber 55 from a rear chamber 56. Furthermore, this EP/M module 7 is provided with a plurality of exhaust gas post treatment modules—two in the illustrated embodiment—, each of which, in a partial housing 10", accommodates an installed exhaust gas post treatment device 6, and together with the latter forms a prefabricated exhaust gas post treatment module. Each of these modules communicates, along with its partial housing 10", with the transfer chamber 12" via a coaxial opening 57 in a transverse wall 54, with the partial housing 10' of each module being connected at an end face to the transverse wall 54. In addition, an outer peripheral portion of the housing 10" of each of the exhaust gas post treatment modules is adapted in a form-fitting manner to an inner peripheral region of the end housing portion 11", the cylindrical starting region 11/1" of which, here with an oval cross-section, peripherally surrounds these partial housings 10" of the exhaust gas post treatment modules; furthermore, the end face of the starting region 11/1" is either secured to the transverse wall 54 in a fixed and gas tight manner, or via a gas tight yet detachable connection mechanism. Downstream of the discharge planes of the exhaust gas post treatment module, the end housing portion 11" tapers via its central portion 11/2", which follows the starting region 11/1", to an end region 11/3" that in the illustrated embodiment is formed by a circular cylindrical end tube via which the end housing portion 11" is guided in a gas tight manner out of the muffler 1. The housing portions 8" and 9", together with the initially installed P-cat 5, also form a prefabricated module, which is then connected with the transverse wall 54.

With the embodiments of FIGS. 17 to 19 and 20 to 22, the respective end housing portion 11' or 11" is realized in the region of its starting and central portion 11/1', 11/1" and 11/2', 11/2" preferably in a double-layered half shell manner of construction, i.e. in each case a prefabricated inner and outer upper half shell is connected with an inner and outer lower half shell, in which now double-walled portion the end tube 11/3' or 11/3" is installed in a gas tight manner. In so doing, in the installed state of the EP/M module 7 there results an end housing portion 11' or 11" having an integrated sound absorption.

The specification incorporates by reference the disclosure of German priority document 103 16 794.4 filed Apr. 11, 2003.

The present invention is, of course, in no way restricted to the specific disclosure of the specification and drawings, but also encompasses any modifications within the scope of the appended claims.

What we claim is:

1. A combination exhaust gas post treatment/muffler device in the exhaust gas section of an internal combustion engine, comprising:

a muffler that is spatially delimited by a front end wall, a rear end wall, and a peripheral outer wall, wherein said muffler is provided with an inlet for exhaust gas that is to undergo post treatment;

at least one exhaust gas post treatment/muffler module built into said muffler as a system core, wherein said at least one module is provided with a housing composed of a plurality of housing portions;

at least one preliminary oxidation catalytic converter disposed in a first one of said housing portions, wherein said at least one catalytic converter significantly increases an amount of $NO_2$ in exhaust gas flowing through said muffler, wherein said first housing portion is followed by a second one of said housing portions, which widens in a funnel-shaped manner and delimits a transfer chamber, and wherein said second housing portion is followed by a third one of said housing portions, at least one exhaust gas post treatment device disposed in said third housing portion, wherein said third housing portion is followed by an end housing portion for collecting cleaned exhaust gas and discharging said cleaned gas from said muffler in a muffled manner; and wherein all of said housing portions of said at least one module are made of ferritic or austenitic stainless steel that is resistant to sulfuric acid, and wherein said front end wall, said rear end wall, said peripheral outer wall, said inlet, and any inner element of said muffler disposed externally of said at least one module are made of an unalloyed sheet steel that is coated with aluminum or other material for protection against corrosion.

2. A combination exhaust gas post treatment/muffler device according to claim 1, wherein said at least one exhaust gas post treatment device is a particle filter, catalytic particle separator or catalyzer or catalytic converter.

3. A combination exhaust gas post treatment/muffler device according to claim 1, wherein said at least one exhaust gas post treatment/muffler module is provided with a housing that is composed of two individual prefabricated parts, wherein either said two first and second housing portions or said three first, second and third housing portions, form a first module housing part, and wherein said third and end housing portions or only said end housing portion forms a second module housing part that is either fixedly connected with said first housing part or is detachably connected therewith via a connection mechanism.

4. A combination exhaust gas post treatment/muffler device according to claim 3, wherein said first housing portion is circular cylindrical and is adapted to an outside of said at least one preliminary oxidation catalytic converter disposed therein, wherein said second housing portion that delimits said transfer channel coaxially follows said first housing portion as a funnel-shaped widened portion and thereafter coaxially follows said third housing portion, which has a circular cylindrical configuration and which is adapted to the outside of said at least one exhaust gas post treatment device disposed therein, and wherein said end housing portion, which forms an exhaust gas/muffler end tube, has a starting portion that coaxially follows said third housing portion with the same diameter as a diameter of said third housing portion and then tapers in a funnel shaped manner and merges into a circular cylindrical end portion via which said end housing portion is guided in a gas tight manner out of said muffler.

5. A combination exhaust gas post treatment/muffler device according to claim 1, wherein said at least one exhaust gas post treatment/muffler module is composed of a plurality of exhaust gas post treatment modules that open into a common end housing portion.

6. A combination exhaust gas post treatment/muffler device according to claim 5, wherein said exhaust gas post treatment modules all have the same configuration and design, and each have a housing, on an inlet side of which is disposed a preliminary oxidation catalytic converter and on an outlet side is disposed an exhaust gas post treatment device, between which is disposed a transfer chamber that widens in a funnel-shaped manner toward said exhaust gas post treatment device.

7. A combination exhaust gas post treatment/muffler device according to claim 6, wherein said housings of said exhaust gas post treatment modules are disposed axis parallel to one another and, in the interior of said muffler, to a longitudinal axis thereof, wherein a transverse wall is disposed in said muffler, wherein said modules pass through openings in said transverse wall and on the outside are gas tight with said transverse wall, wherein said transverse wall separates an exhaust gas flow-in chamber from a further chamber in said muffler, and wherein each of said modules communicates on an input side with said exhaust gas flow-in chamber and on an output side opens out into said end housing portion.

8. A combination exhaust gas post treatment/muffler device according to claim 5, wherein the housing of said exhaust gas post treatment/muffler module is composed of the housing of said exhaust gas post treatment modules and said end housing portion, wherein said first housing portion is formed by the first housing portion of said modules, wherein said second housing portion is formed by the funnel-shaped widening housing portions of said modules, wherein said third housing portion is formed by said third housing portions of said modules, wherein each first housing portion has a circular cylindrical configuration and is adapted to the outside of said preliminary oxidation catalytic converter disposed therein, wherein said second housing portion, which widens in a funnel-shaped manner and delimits a transfer chamber, coaxially follows said first housing portion and is in turn coaxially followed by said circular cylindrical third housing portion, which is adapted to the outside of said exhaust gas post treatment device disposed therein.

9. A combination exhaust gas post treatment/muffler device according to claim 7, wherein a starting portion of said end housing portion peripherally surrounds an outside of said third housing portion of said exhaust gas post treatment modules and is peripherally adapted in a form-fitting manner to peripheral portions of said modules, wherein said starting portion of said end housing portion is fixedly secured at an end face in a gas tight manner to said transverse wall or is secured in a gas tight manner thereto via a detachable connecting mechanism, wherein a central portion of said end housing portion, downstream of discharge planes of said exhaust gas post treatment modules, tapers in a funnel-shaped manner to an end region that is preferably formed by a circular cylindrical end tube via which said end housing portion is guided out of said muffler in a gas tight manner.

10. A combination exhaust gas post treatment/muffler device according to claim 1, wherein said at least one exhaust gas post treatment/muffler module is provided with a housing composed of a plurality of individually prefabricated partial housings, wherein a preliminary oxidation catalytic converter is disposed in said preferably circular cylindrical first housing portion, which is coaxially followed by a second housing portion that widens in a funnel-shaped manner, delimits a transfer chamber and on an end is connected in a gas tight manner to a transverse wall that in said muffler separates an exhaust gas flow-in chamber from another chamber, wherein said at least one exhaust gas post treatment/muffler module is provided with a plurality of gas exhaust post treatment modules, each of which accommodates, in one of said partial housings, an exhaust gas post treatment device disposed therein, wherein each of said modules, along with its partial housing, communicates via a respective opening in said transverse wall with said transverse chamber, and on an end face is connected in a gas tight manner to said transverse wall and via an outer peripheral portion is adapted in a form-fitting manner to an inner peripheral region of said end housing portion, wherein a starting region of said end housing portion peripherally surrounds an outside of said partial housings of said exhaust gas post treatment modules, wherein an end face of said starting region is fixedly secured in a gas tight manner to said transverse wall or is secured thereto via a detachable connection mechanism, and wherein a central portion of said end housing portion, downstream of discharge planes of said modules, tapers to an end region that is preferably formed by a circular cylindrical end tube via which said end housing portion is guided out of said muffler in a gas tight manner.

11. A combination exhaust gas post treatment/muffler device according to claim 1, wherein said end housing portion, for sound-dampening purposes, is entirely or partially perforated or provided with individual holes, and/or is coated on the outside over its entire length or over only part of its length with sound-dampening material.

12. A combination exhaust gas post treatment/muffler device according to claim 3, wherein said at least one exhaust gas post treatment/muffler module is fixed in position in an inner space of said muffler via at least one gas tight or exhaust gas permeable transverse wall or support.

* * * * *

UNITED STATES PATENT AND TRADEMARK OFFICE

CERTIFICATE OF CORRECTION

PATENT NO. : 7,273,592 B2
APPLICATION NO. : 10/822543
DATED : September 25, 2007
INVENTOR(S) : Jacob Eberhard et al.

It is certified that error appears in the above-identified patent and that said Letters Patent is hereby corrected as shown below:

Title page,

Item (73) should read as follows:

(73) Assignees: MAN Nutzfahrzeuge Aktiengesselschaft (DE); Roth-Technik Austria Ges.m.b.H (DE)

Signed and Sealed this

Eleventh Day of December, 2007

JON W. DUDAS
*Director of the United States Patent and Trademark Office*